US009108706B2

(12) United States Patent
Doerr

(10) Patent No.: US 9,108,706 B2
(45) Date of Patent: Aug. 18, 2015

(54) RETRACTABLE WAKE SURFING TETHER

(71) Applicant: Benjamin Doerr, West Bloomfield, MI (US)

(72) Inventor: Benjamin Doerr, West Bloomfield, MI (US)

( * ) Notice: Subject to any disclaimer, the term of this patent is extended or adjusted under 35 U.S.C. 154(b) by 68 days.

(21) Appl. No.: 13/804,487

(22) Filed: Mar. 14, 2013

(65) Prior Publication Data

US 2014/0263795 A1 Sep. 18, 2014

(51) Int. Cl.
*B63B 35/81* (2006.01)

(52) U.S. Cl.
CPC ..... *B63B 35/816* (2013.01)

(58) Field of Classification Search
CPC ..... B63B 35/815; B63B 35/816
USPC ..... 114/253, 254; 441/68, 69, 84; 403/2; 242/378, 378.1, 378.2, 379, 379.2, 242/579, 586, 586.2, 586.3, 904, 305; 440/1; 43/17
See application file for complete search history.

(56) References Cited

U.S. PATENT DOCUMENTS

| | | | | |
|---|---|---|---|---|
| 4,567,961 | A * | 2/1986 | Schoenfeld | 182/3 |
| 4,624,141 | A * | 11/1986 | Soleau | 73/865.8 |
| 5,838,227 | A * | 11/1998 | Murray | 340/539.21 |
| 7,109,871 | B2 * | 9/2006 | Lentine et al. | 340/573.6 |
| 7,497,181 | B2 * | 3/2009 | Viggiano et al. | 114/102.1 |
| 8,562,383 | B2 * | 10/2013 | Weiss | 441/69 |
| 2006/0027155 | A1 * | 2/2006 | Welch | 114/254 |
| 2007/0023557 | A1 * | 2/2007 | Rankin, VI | 242/381 |
| 2010/0211239 | A1 * | 8/2010 | Christensen et al. | 701/21 |
| 2012/0060740 | A1 * | 3/2012 | Stevens et al. | 114/218 |
| 2012/0201605 | A1 * | 8/2012 | Hill | 405/79 |

* cited by examiner

*Primary Examiner* — Joshua Kennedy

(57) ABSTRACT

An retractable tether device is used to alert the driver of a fallen athlete and to return the athlete, primarily a wake surfer, back to position behind the watercraft. The tether consists of a coil spring with a storage reel for the line and an audible alert notification. When a wake surfer falls off the surfboard, the tether will pull out from the device. Simultaneously, the boat stops and the coil spring will retract the tether to reposition the wake surfer behind the boat. As the tether is reeled out, an alert such as an audible noise and/or vibratory signal will cue the driver that the wake surfer has fallen. To further ensure safety, each end of the apparatus would have break away clips. The safety break away clips would release in the case where the driver did not stop the boat. The tether could be connected to the tower, pylon or back of the boat's towable hook. As a result of this device, the surfer can efficiently engage in an increased number of wake surfing sessions.

8 Claims, 3 Drawing Sheets

RETRACTABLE WAKE SURFING TETHER

FIELD

The present teachings relate to a retractable wake surfing device and, more specifically, to a retractable wake surfing tether.

BACKGROUND

Wakesurfing is a water sport in which a surfer surfs behind a wakeboard boat, surfing on the boat's wake without being directly attached to the boat. The wake from the back of the boat mimics the feeling of surfing on an ocean wave. After getting up on the wave, with the use of a short knotted tow rope, the wakesurfer can drop the rope and ride the face of the wave.

The boat is usually weighted down using water ballast. The use of the ballast forces the boat lower into the water creating a bigger wake. The weight is generally placed more onto the side in which the wake surfer wants to surf.

When the surfer falls, the spotter on the watercraft will notify the driver. The driver turns the boat around and positioning the back of the boat close to the surfer to start again. The said ballast is generally loaded with weight on one side of the boat making maneuverability difficult and time consuming. The current solution is to slow the speed of the boat and steadily turn around. The driver will then position the boat alongside the surfer. The passenger or spotter will throw the wake surfing rope to the surfer once the surfer is within reach.

SUMMARY OF THE INVENTION

The invention is to attach a tether to the wakesurfer with a harness apparatus, allowing the surfer's hands to be free to maneuver. When the surfer falls, the spring tensioned tether and reel apparatus unreels the line. The boat slows to a stop and the power spring pulls the tether which is attached to the surfer back to the boat as the surfer swims. The boat would remain idle and the wakesurfer repositions to the rear of the boat where the surf rope can be held to resume wakesurfing.

The invention includes a power spring, electrified motor or mechanical crank to retract the wakesurfer back to the boat. The idea would also include a safety breakaway clip attached to the harness and the harness attached to wake surfer. If completely unwound, another safety breakaway clip is located at the end of reel.

BRIEF DESCRIPTION OF THE DRAWINGS

The manner in which the wake surfing tether is characteristics can be obtained is explained in the following description and attached drawings in which.

DETAILED DESCRIPTION

Figure 1:
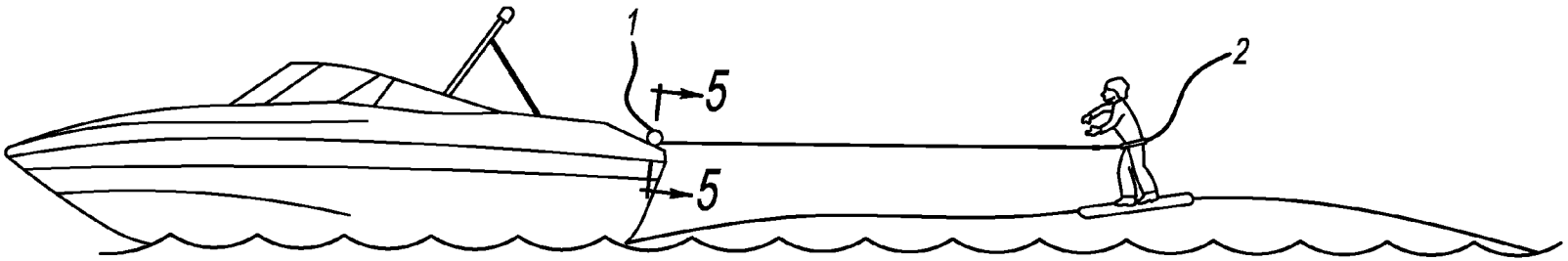
FIG. 1 is a perspective drawing of a wake surfing riding a wake with the tether attached.
Figure 2:
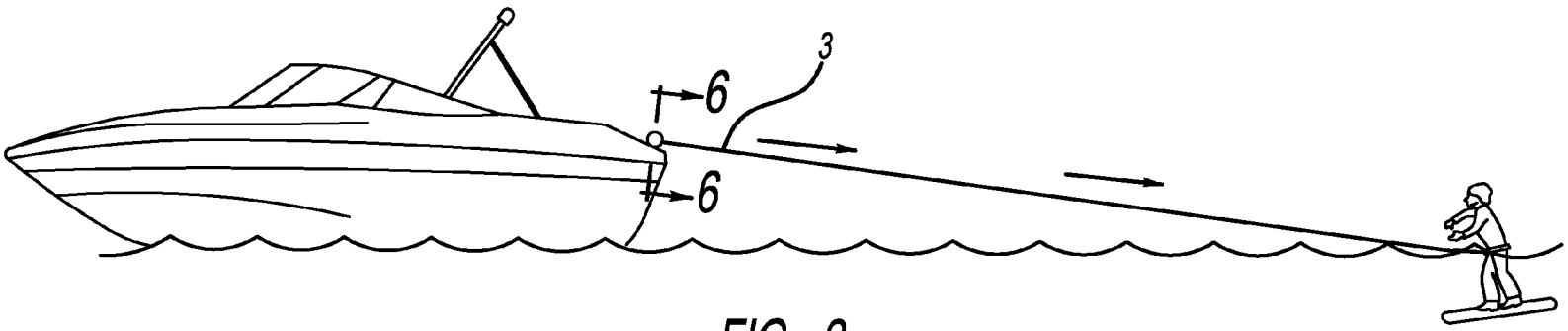
FIG. 2 is a perspective drawing of a wake surfing that has lost the wake with the tether attached and reeling out, while the boat is stopping. While the reel is spinning out the audible noise is alerting the driver.
Figure 5:
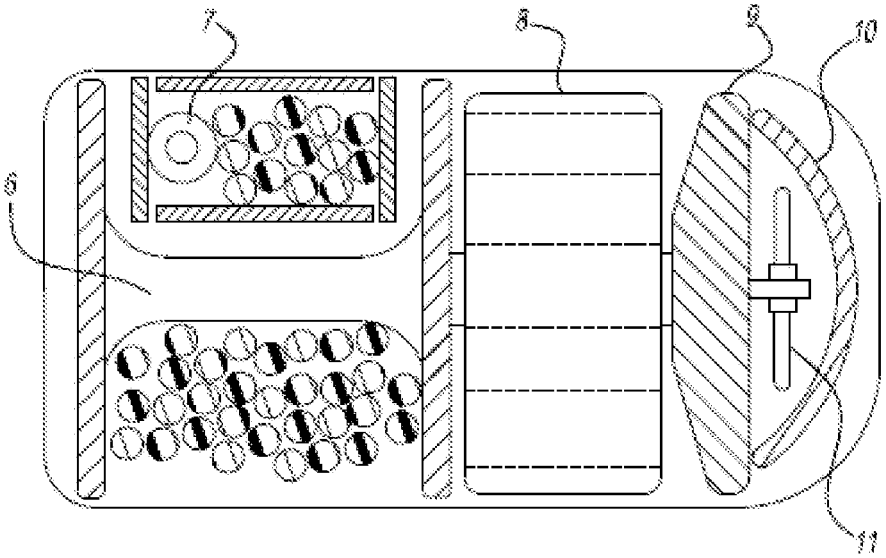
FIG. 5 is a cross-sectional side view of the wake surf reel as shown in FIG. 1 while surfing the tether is primarily in a static position.
Figure 6:
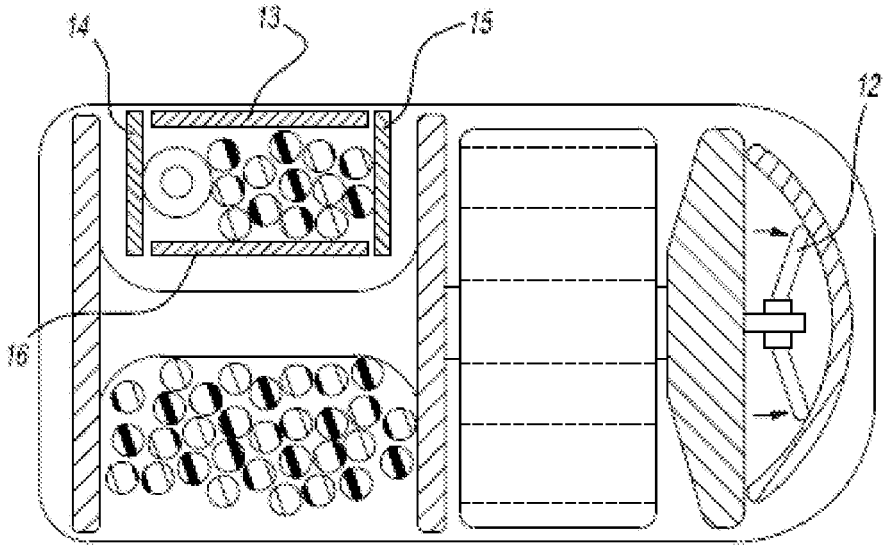
FIG. 6 is a cross-sectional side view of the wake surf reel as shown in FIG. 2 while the reel is reeling out causing the audible portion to touch the bell.

FIG. 1 sets perspective view of a wake surfing having the wake surfing tether attached to the wake surfer 2 and the wake surfing reel 1 attached to the boat. The tether is held with slight tension by a power spring 8 allowing the surfer to ride up and down the wake with ease. A reel 6 within the device holds the excess tether line. In the perspective view of FIG. 2 the wake surfer has fallen into the water and is no longer surfing at which time the reel 6 is unwinding the tether 2 while creating an audible noise with the clapper 11 and 12 is flung into the bell 10 by centrifugal force shown in FIG. 5 and FIG. 6. The audible noise will help alert the driver that the wake surfer has fallen. Once the boat has come to a stop the reel 6 will pull the tether 2 back to the rear of the boat into position to quickly start again wake surfing. The tether is pulled using the power spring 8 and the return speed is slowed with a one directional rotational damper 9. The tether is stored in the reel 6 and guided into the housing shown in FIG. 6 using the directional rollers of horizontal guides 16 and 13 and vertical guides 14 and 15. In the case the driver doesn't stop or doesn't stop fast enough and the tether 2 could unreel to the end of the, at which time the wake surfer is directly connected to the boat; two breakaway clip, one clip 7 the reel 6 and the other one on the tether 2 connected to the wake surfer 5.

Figure 3:
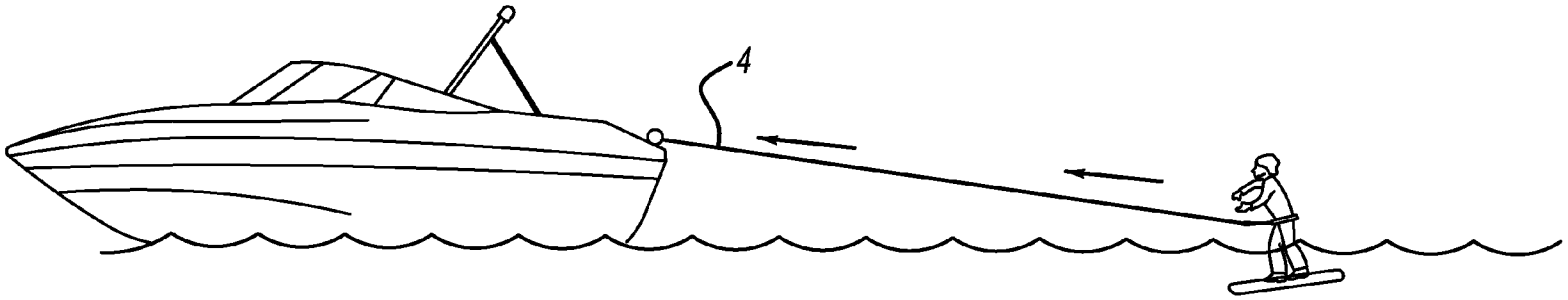
FIG. 3 is a perspective drawing of a wake surfing with the tether attached and the boat has stopped, and the tether is reeling the wake surfer back into position behind the boat.

FIG. 3 sets perspective view of the power spring 8 which rotates the reel 6 pulling the tether back into the device. The speed at which it rotates is controlled by the use of a unidirectional damper 9 in which it is only damping in one direction. The other direction is free spinning to allow the tether to reel out from the device so the wake surfer that has fallen is not pulled hard by the reel 6. The boat slowing the boat down once the wake surfer has fallen which has lowered the resistance of the wake surfer in the water and the boat coming to a stop will allow for the force of the power spring 8 to reel in the tether 2.

Figure 4:
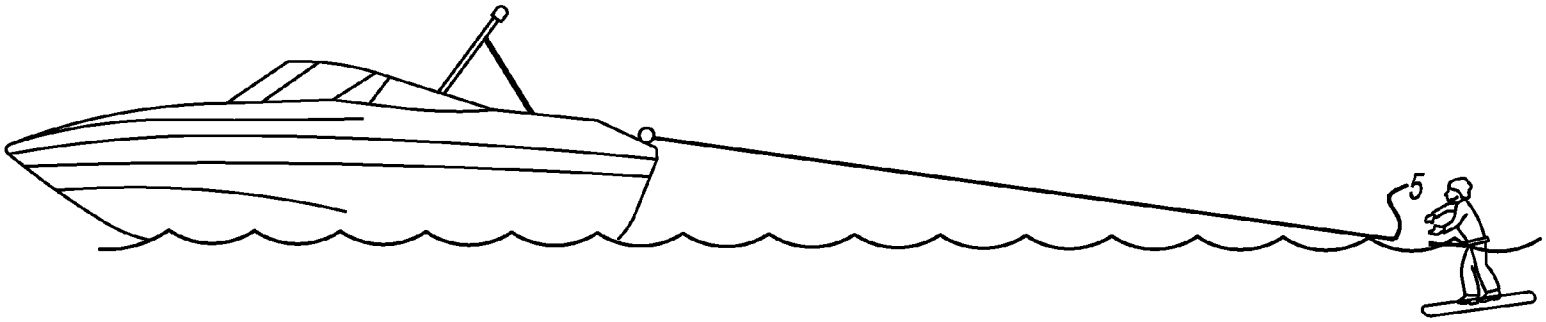
FIG. 4 is a perspective drawing of a wake surfer, in the case that the boat does not stop; the tether will breakaway from the wake surfer by a safety breakaway clip.

FIG. 4 sets the perspective view of the illustration of the event that the wake surfer has fallen and the boat has not slowed. The tether 2 being directly attached to the surfer would un-reel the entire wound up tether line at which time abruptly coming to the end. Each end of the tether 2 has a breakaway clip 7 attached as a safety precaution. The speed and mass of the boat would overcome either one or both of the breakaway clips 7 protecting the wake surfer. The tether has the two breakaway clips in case either side of the tether 2 if tangled. The surfer side could get tangled in the wake surfer then the breakaway clip 7 at the reel would breakaway. Also, for the other side if the reel has malfunctioned the not reeling out then the breakaway clip on the wake surfer would breakaway from the wake surfer.

The system further comprising a wireless device attached to the rotational device and an alert device visible by a driver of the boat, the wireless device being configured to actuate the alert device based on reeling out of the tether. The system further comprising an actuator device in communication with an engine control module and configured to reduce an engine speed based on reeling out of the tether FIG. 2. The system wherein the actuator device reduces the engine speed to an idle speed based on reeling out of the tether. The system further comprising an actuator device in communication with a transmission control device and configured to disengage a transmission of the boat based on reeling out of the tether. The system further comprising an actuator device in communication with an engine control device and a transmission control device, wherein the actuator device is configured to reduce an engine speed and to disengage a transmission of the boat based on reeling out of the tether FIG. 2.

The invention claimed is:

1. A wake surfing tether system attached to a boat comprising:

a. a rotational device attached to the boat, the rotational device having a power spring;

b. a tether attached at a first end to the rotational device with a first breakaway clip;

c. a second breakaway clip attached to a second end of the tether and configured for attachment to a user;

d. a damper attached to the power spring, the power spring being configured to hold the tether with slight tension when attached to the user while in a surfing position and the damper controlling a speed at which the tether is returned;

wherein when tension of the tether is increased due the user falling into the water from the surfing position, a resistance is created causing the tether to pull out of the rotational device until the boat comes to a stop or one of the first or second breakaway clips breaks away or the resistance applied to the tether due to the fallen user is otherwise lowered;

once the resistance is lowered, the power spring pulls the tether and reels the tether in to the boat.

2. The system of claim 1 further comprising an audible alert device attached to the rotational device, wherein the audible alert device is activated by reeling out of the tether.

3. The system of claim 1 further comprising a vibration alert device attached to the rotational device, wherein the vibration device is activated by reeling out of the tether.

4. The system of claim 1 further comprising a wireless device attached to the rotational device and an alert device visible by a driver of the boat, the wireless device being configured to actuate the alert device based on reeling out of the tether.

5. The system of claim 1 further comprising an actuator device in communication with an engine control module of the boat and configured to reduce an engine speed based on reeling out of the tether.

6. The system of claim 5, wherein the actuator device reduced the engine speed to an idle speed based on reeling out of the tether.

7. The system of claim 1 further comprising an actuator device in communication with a transmission control device and configured to disengage a transmission of the boat based on reeling out of the tether.

8. The system of claim 1 further comprising an actuator device in communication with an engine control device and a transmission control device, wherein the actuator device is configured to reduce an engine speed and to disengage a transmission of the boat based on reeling out of the tether.

* * * * *